US010814161B2

(12) United States Patent
Gatti et al.

(10) Patent No.: US 10,814,161 B2
(45) Date of Patent: Oct. 27, 2020

(54) GYMNASTIC MACHINE WITH MOVABLE STEPS AND OPERATION METHOD THEREOF

(71) Applicant: TECHNOGYM S.P.A., Cesena (IT)

(72) Inventors: Davide Gatti, Cesena (IT); Alessandro Bellavista, Cesena (IT); Alessandro Del Monaco, Cesena (IT); Claudio Serra, Cesena (IT)

(73) Assignee: TECHNOGYM S.P.A., Cesena FC (IT)

( * ) Notice: Subject to any disclaimer, the term of this patent is extended or adjusted under 35 U.S.C. 154(b) by 179 days.

(21) Appl. No.: 15/445,140

(22) Filed: Feb. 28, 2017

(65) Prior Publication Data

US 2017/0246500 A1 Aug. 31, 2017

(30) Foreign Application Priority Data

Feb. 29, 2016 (IT) ..... 102016000020967

(51) Int. Cl.
*A63B 22/04* (2006.01)
*A63B 21/005* (2006.01)
(Continued)

(52) U.S. Cl.
CPC ..... *A63B 22/04* (2013.01); *A63B 21/005* (2013.01); *A63B 21/15* (2013.01); *A63B 23/04* (2013.01);
(Continued)

(58) Field of Classification Search
CPC ..... A63B 22/04; A63B 23/04; A63B 21/15; A63B 21/005; A63B 24/0087;
(Continued)

(56) References Cited

U.S. PATENT DOCUMENTS 783,769 A * 2/1905 Wright ..... B66B 23/12 198/333
5,374,227 A * 12/1994 Webb ..... A63B 21/157 482/51
(Continued)

FOREIGN PATENT DOCUMENTS

DE 88 12 576 U1 12/1988
JP 2011-056168 A 3/2011
(Continued)

OTHER PUBLICATIONS

Italian Search Report issued in Italian Patent Application No. ITUB20161151 dated Nov. 8, 2016.

*Primary Examiner* — Loan B Jimenez
*Assistant Examiner* — Shila Jalalzadeh Abyaneh
(74) *Attorney, Agent, or Firm* — Arent Fox LLP

(57) ABSTRACT

The present invention concerns a gymnastic machine of the type having movable steps, comprising a supporting frame, for the resting of said gymnastic machine on the floor, a movable stair comprising a plurality of elongated elements, each elongated element being hinged in series to a preceding elongated element and to a following elongated element, so as to form a closed series, two consecutive elongated elements forming a step of said movable stair acting respectively as tread and riser, said gymnastic machine being characterized in that at least one elongated element comprises at least one first and one second part articulated to each other.

The present invention also concerns an operating method of said gymnastic machine.

16 Claims, 6 Drawing Sheets

(51) Int. Cl.

| | |
|---|---|
| ***A63B 24/00*** | (2006.01) |
| ***A63B 21/00*** | (2006.01) |
| ***A63B 23/04*** | (2006.01) |
| *A63B 69/00* | (2006.01) |

(52) U.S. Cl.
CPC ..... *A63B 24/0087* (2013.01); *A63B 69/0057* (2013.01); *A63B 2220/833* (2013.01)

(58) Field of Classification Search
CPC ..... A63B 2220/833; A63B 69/0057; A63B 22/06; A63B 2220/17; A63B 2220/805
See application file for complete search history.

(56) References Cited

U.S. PATENT DOCUMENTS 5,381,881 A * 1/1995 Meyer ..... B66B 31/006 198/333
5,556,352 A * 9/1996 Chang ..... A63B 22/04 482/51
9,238,158 B2 * 1/2016 Strommen ..... A63B 22/04
9,713,737 B2 * 7/2017 Chen ..... A63B 21/4034
2012/0238409 A1 * 9/2012 Halsey ..... A63B 71/0619 482/52
2012/0264572 A1 * 10/2012 Fenster ..... A63B 21/0051 482/52
2015/0165263 A1 * 6/2015 Golen, Jr. ..... A63B 21/0058 482/7
2017/0014673 A1 * 1/2017 Andrade ..... A63B 21/0051

FOREIGN PATENT DOCUMENTS

TW M 447 247 U 2/2013
WO WO 2015/095563 A1 6/2015

* cited by examiner

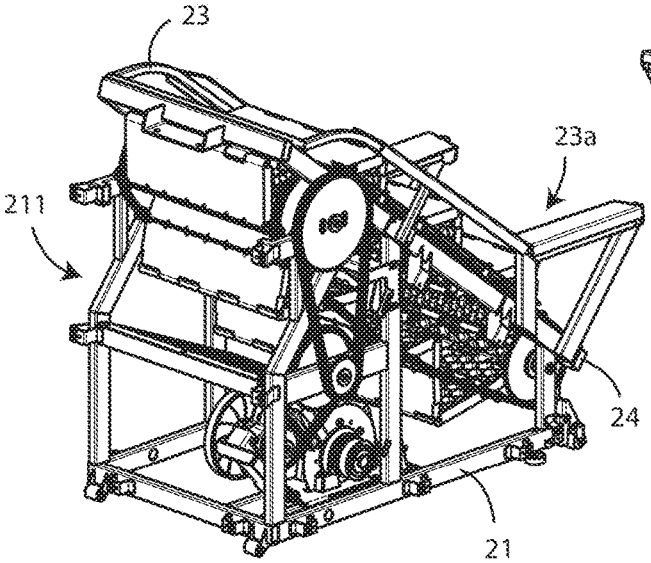
Fig. 7A
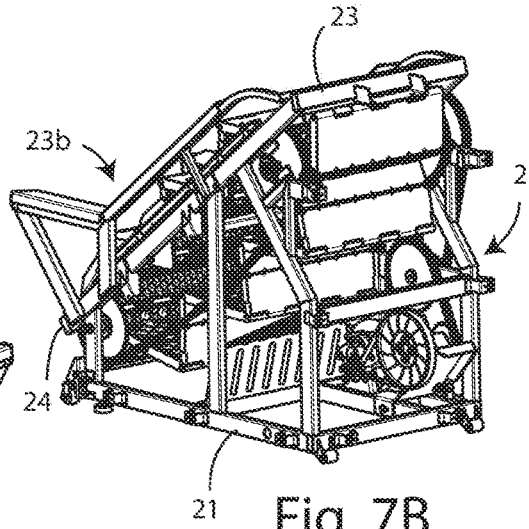
Fig. 7B
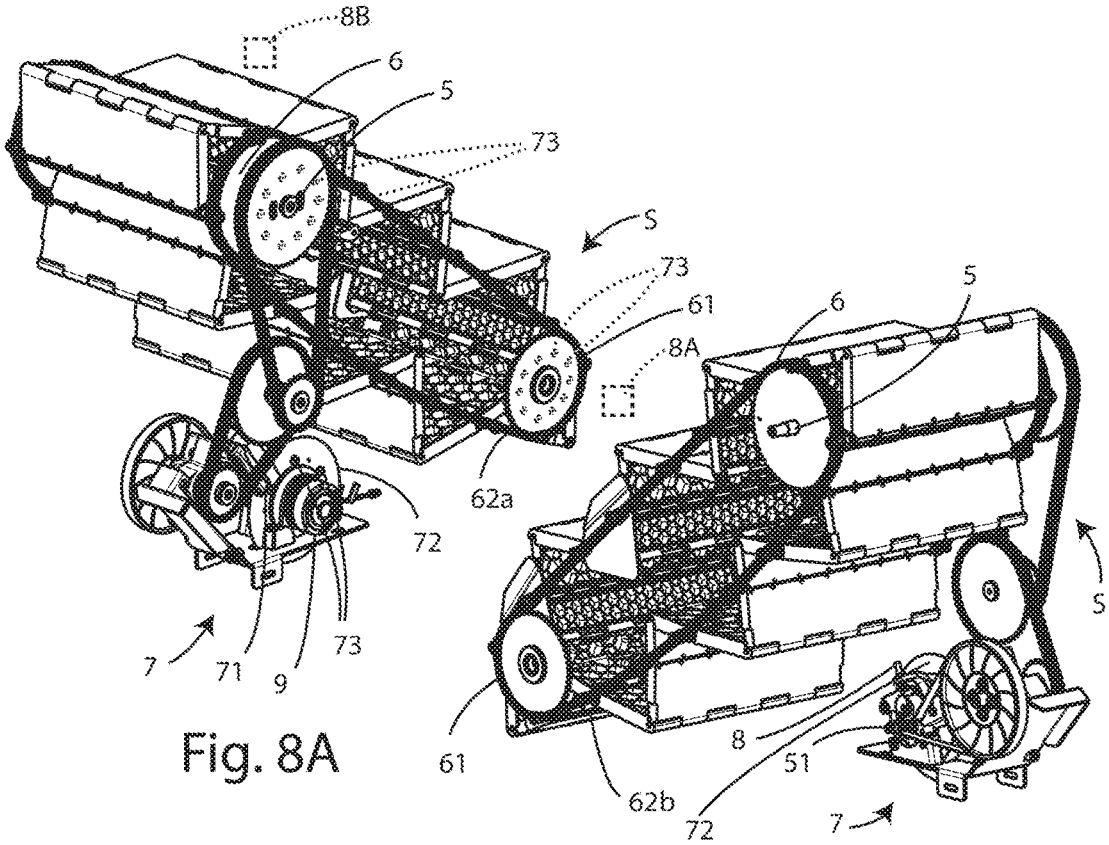
Fig. 8A
Fig. 8B

GYMNASTIC MACHINE WITH MOVABLE STEPS AND OPERATION METHOD THEREOF

The present invention relates to a gymnastic machine with movable steps.

The present invention also relates to the operation method of the gymnastic machine with movable steps.

In the following, the description will be directed to gymnastic machine with movable steps, on which a stair climb is simulated, but it is clear that the same should not be considered limited to this specific use.

More specifically, the invention relates to a gymnastic machine of the above type, studied and realized in particular for carrying out a gymnastic exercise simulating a climb on steps that move in a continuous closed circuit.

In the following, the description will be directed to a gymnastic machine with movable steps, on which an climb is simulated, but it is clear that the same should not be considered limited to this specific use.

As it is well known at present gymnastic machines with movable steps or "stepmill" are used to carry out gymnastic exercises for high intensity training of specific areas of the body, such as the muscles of the legs, especially the hamstrings, quadriceps and glutes.

Training intensity means the degree of physical effort required to a user during the execution of a particular gymnastic exercise.

The above stepmill machines currently in the market comprise a plurality of continuously sliding movable steps, typically eight.

Each step comprises a raiser and a tread and in some of said known machines, said riser and tread are hinged together by a hinge. In particular, the tread is the depth of the step, on which the user rests his or her foot, while the riser is the difference in height between the tread of a step and the tread of a following step.

Usually, the elongated elements that form the treads and the risers are arranged transversely with respect to the sliding direction of the stair.

The elongated elements that form the risers and the treads of said steps are hinged together by means of through pins and thus form a closed circuit or a closed series. Some of these pins are connected with two synchronous or asynchronous transmission chains placed at the right and left of the steps that drag the whole stair in motion.

The known type of stepmill machines are very high because of the volume of the envelope of the steps in the lower part of the machine. This renders uncomfortable the user working position during the execution of a gymnastic exercise, being at an elevated height with respect to the ground.

Furthermore, as described above, the first step on which the user go up to start the gymnastic exercise is located at a high height above the ground, therefore making uncomfortable the access to the machine and the descend from the same machine.

In the light of the above, it is, therefore, object of the present invention providing an exercise machine with movable steps that has a reduced total volume and encumbrance.

Another object of the invention is to provide an gymnastic machine comprising a first step arranged at a height such as to ease the accessibility for a user.

A further object of the present invention is to provide a gymnastic machine, which has an increased the area useful for the exercise.

A last object of the present invention is to provide an operating method of the gymnastic machine with movable steps, in which the control of the stair movement is carried out using only one of already existing velocity sensor.

It is therefore specific object of the present invention a gymnastic machine of the type having movable steps, comprising a supporting frame, for the resting of said gymnastic machine on the floor, a movable stair comprising a plurality of elongated elements, each elongated element being hinged in series to a preceding elongated element and to a following elongated element, so as to form a closed series, two consecutive elongated elements forming a step of said movable stair acting respectively as tread and riser, said gymnastic machine being characterized in that at least one elongated element comprises at least one first and one second part articulated to each other.

Further according to the invention, said gymnastic machine comprises a motion transmission system, installed on said supporting frame, to transmit the motion to said movable stair.

Preferably according to the invention, said movable stair and said motion transmission system are configured so that, during the rotation of said movable stair, said first part of each elongated element, when it is in close proximity to the floor, articulating itself with respect to said second part of the same elongated element, arranges substantially horizontal to said floor.

Always according to the invention, each first part of each elongated element is articulated by means of hinges to the respective second part of the same elongated element and to the second part of the elongated element adjacent to said first part.

Still according to the invention, each elongated element and the following elongated element or the previous elongated element, articulated to said elongated element, form a step, in particular an elongated element is the tread and the following elongated element is the riser of said step.

Further according to the invention, said elongated elements are articulated to each other by means of a main hinge, and said first and second part are articulated to each other by means of a secondary hinge.

Preferably according to the invention, each first and second part of each elongated element have the same dimensions.

Always according to the invention, each articulation secondary hinge of said first and second part of each step has two pivots at its ends.

Still according to the invention, said motion transmission system comprises two transmission members, such as chains, belts and the like, arranged respectively at the sides of said movable stair, and said transmission members are hinged on said pivots.

Further according to the invention, said motion transmission system comprises a main shaft arranged on the upper part of said supporting frame, a first couple of toothed wheels coupled to the ends of said main shaft, a second couple of toothed wheels rotatably coupled in correspondence of the lower part of said supporting frame, and each of said two transmission members is engaged with a respective toothed wheel of said first couple of toothed wheels and a respective toothed wheel of said second couple of toothed wheels.

Preferably according to the invention, said motion transmission system comprises a braking device, coupled with one of the toothed wheel of said first couple of toothed wheels by means of further transmission members of said motion transmission system.

Always according to the invention, said braking device comprises an electromagnetic braking member coupled with a disk.

Still according to the invention, said disk is provided with a plurality of markers on its surface, and said gymnastic machine comprises a sensor, arranged in correspondence of said braking device, so as to detect the passage of each marker during the rotation of said disk, so as to emit a pulse.

Further according to the invention, any one of said first couple and/or second couple of toothed wheels and/or further toothed wheels of said motion transmission system provides with a plurality of markers, and said gymnastic machine comprises a sensor, arranged in correspondence of said first couple and/or second couple of toothed wheels and/or further toothed wheels of said motion transmission system, so as to detect the passage of each marker during the rotation of said first couple and/or second couple of toothed wheels and/or further toothed wheels of said motion transmission system, so as to emit a pulse.

Preferably according to the invention, said gymnastic machine comprises a control logic unit, provided with a program to calculate the stop position of said movable stair at the end of a gymnastic exercise, so that said first part of each elongated element, when in close proximity of the floor, arranges substantially horizontal with respect to said floor.

Still according to the invention, each one of said elongated elements comprises at least one first and one second part articulated to each other.

It is further object of the present invention an operating method of a gymnastic machine as described above, comprising the following steps:

a. reducing the rotation of said movable stair of said gymnastic machine;

b. stopping said movable stair in a final stop position so that the first part of the elongated element, which is in close proximity of the floor, is substantially horizontal to said floor.

Further according to the invention, the transition from said step a. to said step b. takes place rotating said movable stair in one direction or in the opposite one.

Still according to the invention, said method comprises the steps of storing in said control logic unit a plurality of values (N, Z, $X_{eff}$), which measure the number of said pulses emitted by said sensor and the number of rounds of said disk during the operation of said gymnastic machine, and running said step b., carrying out a reading, a comparison and the following update of said values (N, Z, $X_{eff}$) according to a predetermined procedure.

Preferred embodiments are defined in the dependent claims.

The present invention will be now described, for illustrative but not limitative purposes, according to its preferred embodiments, with particular reference to the figures of the enclosed drawings, wherein:

FIG. 7A shows a schematic left rear view of the gymnastic machine object of the present invention;

FIG. 7B shows a schematic right rear view of the gymnastic machine object of the present invention;

FIG. 8A shows a schematic left rear view of the gymnastic machine of FIG. 7A without the frame;

FIG. 8B shows a schematic right rear view of the gymnastic machine of FIG. 7B, without the frame;

In the various Figures, similar parts will be indicated by the same reference numbers.

Figure 1:
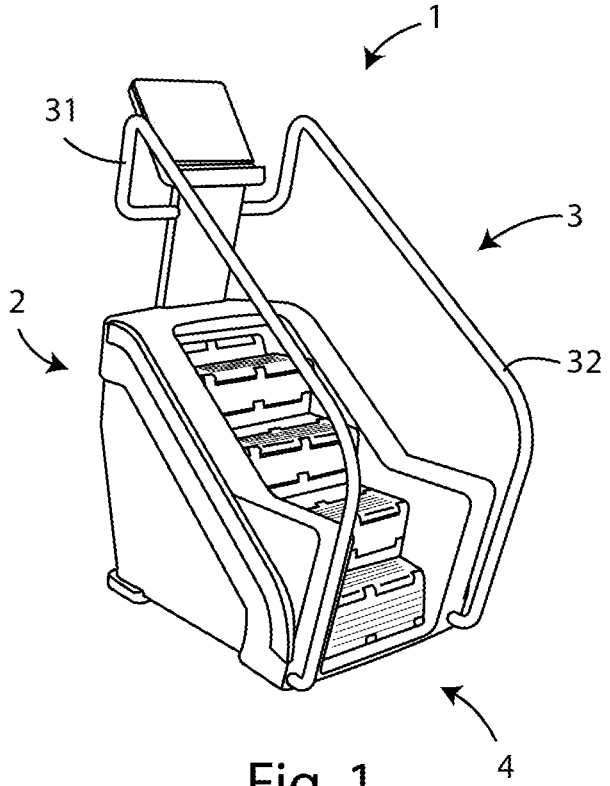
FIG. 1 shows a perspective view of the gymnastic machine with movable steps object of the present invention.
Figure 2:
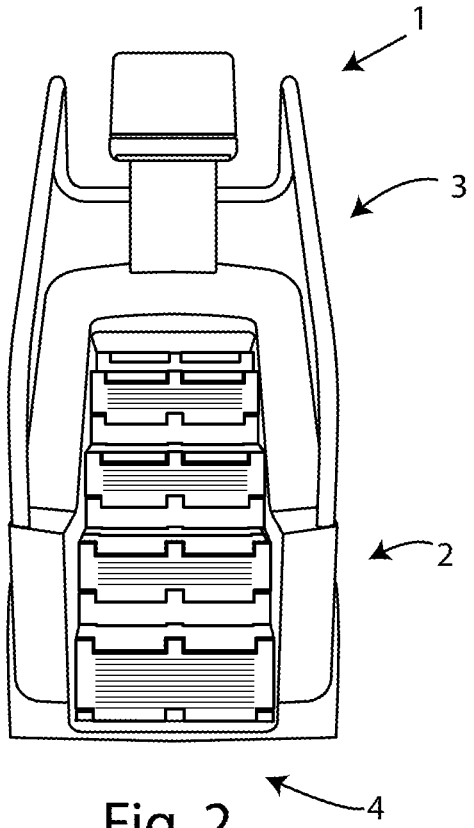
FIG. 2 shows a front view of the gymnastic machine of FIG. 1.
Figure 3:
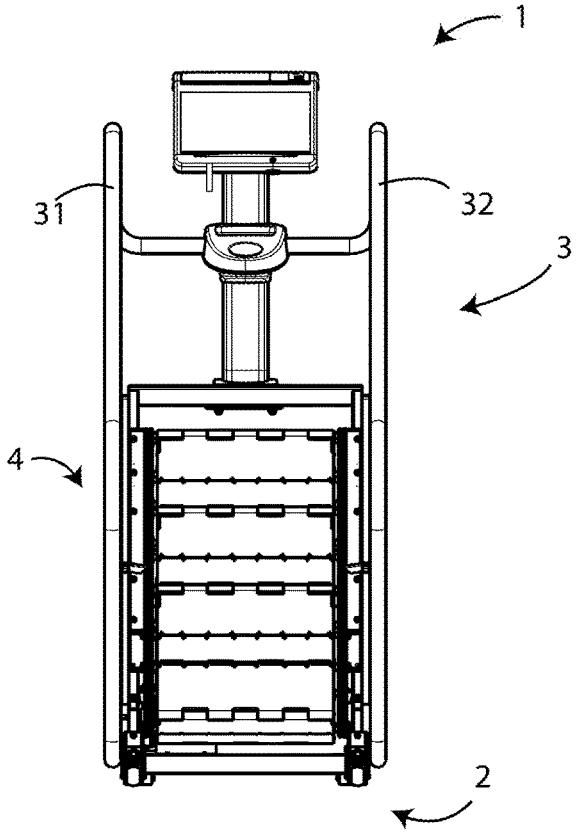
FIG. 3 shows a schematic front view of the gymnastic machine object of the present invention.
Figure 4:
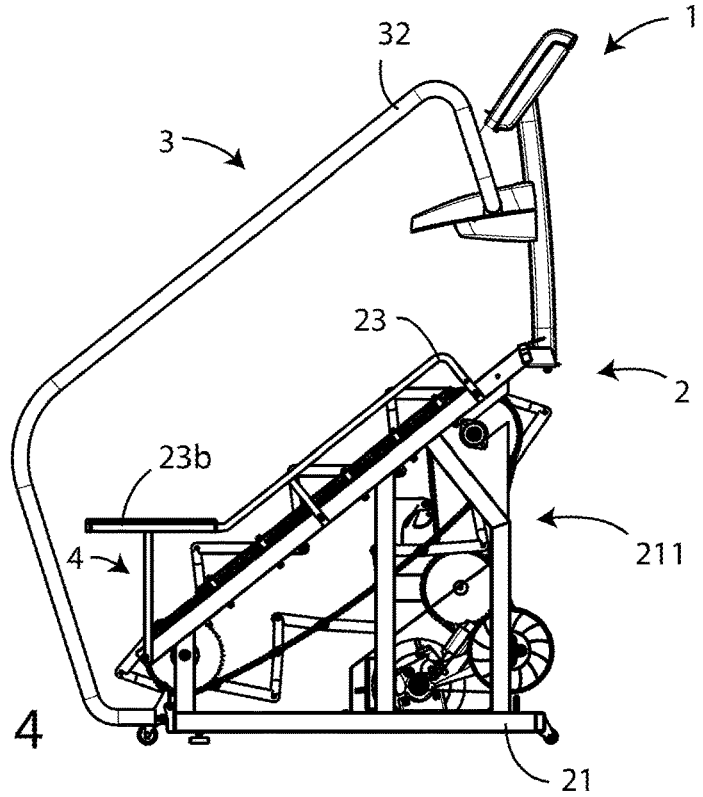
FIG. 4 shows a schematic right side view of the gymnastic machine of FIG. 3.
Figure 5:
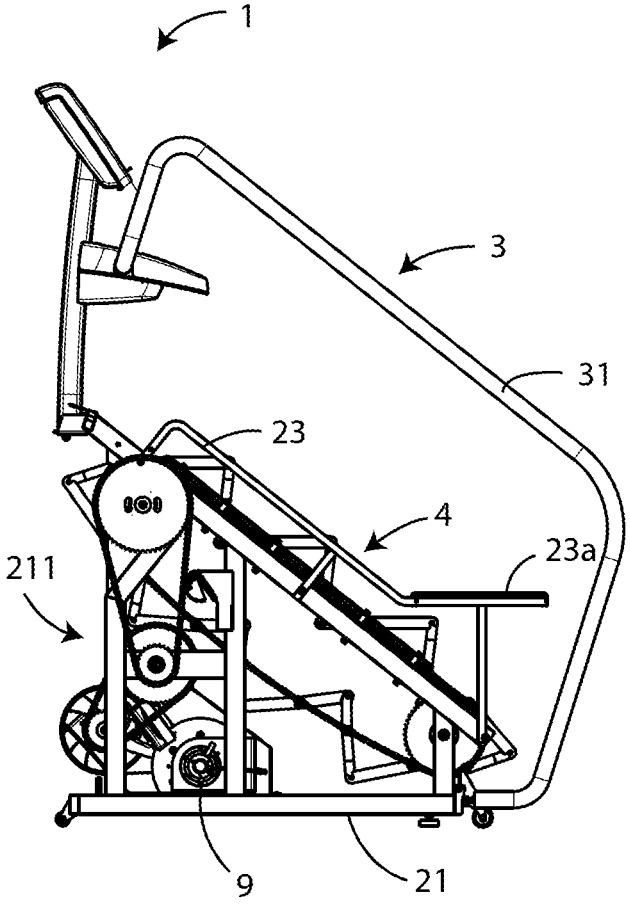
FIG. 5 shows a schematic left side view of the gymnastic machine of FIG. 3.

Referring to FIGS. 1-5, the gymnastic machine 1 essentially comprises a support frame 2, which is arranged on a floor, a support structure 3 and a movement assembly 4, which is set in motion by a user during the execution of a gymnastic exercise.

Said supporting frame 2 comprises a base 21, a plurality of supports 211 and a frame 23, supported by said plurality of supports 211.

Said frame 23 comprises a pair of inclined guides 24 for the sliding of pins, as will be described in detail hereinafter.

On said pair of inclined guides 24, a first inclined surface 23*a* and a second inclined surface 23*b* are mounted, arranged parallel to each other, which function will be described more in detail hereinafter.

Said supporting frame 2 is covered by a cover casing, so that, when it is in pause between a gymnastic exercise and the following one, or to execute certain exercise programs, the user can place his feet on said casing in correspondence of said first 23*a* and second 23*b* inclined support surface, without being forced to return on the floor.

Said support structure 3 comprises a first 31 and a second handrail 32, parallel and coupled with said cover casing of said supporting frame 2 for supporting the user's upper limbs during the gymnastic exercise.

Said supporting structure 3 also comprises a control logic unit, one or more memory units and a display for the interface with the user.

Said control logic unit can be comprised also in the lower part of said gymnastic machine 1.

Referring to FIGS. 6-9, said moving assembly 4 is arranged in said supporting frame 2. Said moving assembly 4 comprises a movable stair 41 comprised of a plurality of mutually articulated steps. In particular, said movable stair 41 comprises eight steps $\mathbf{41}_a$, $\mathbf{41}_b$, . . . $\mathbf{41}_n$, rotatably movable by means of a motion transmission system S.

Figure 6A:
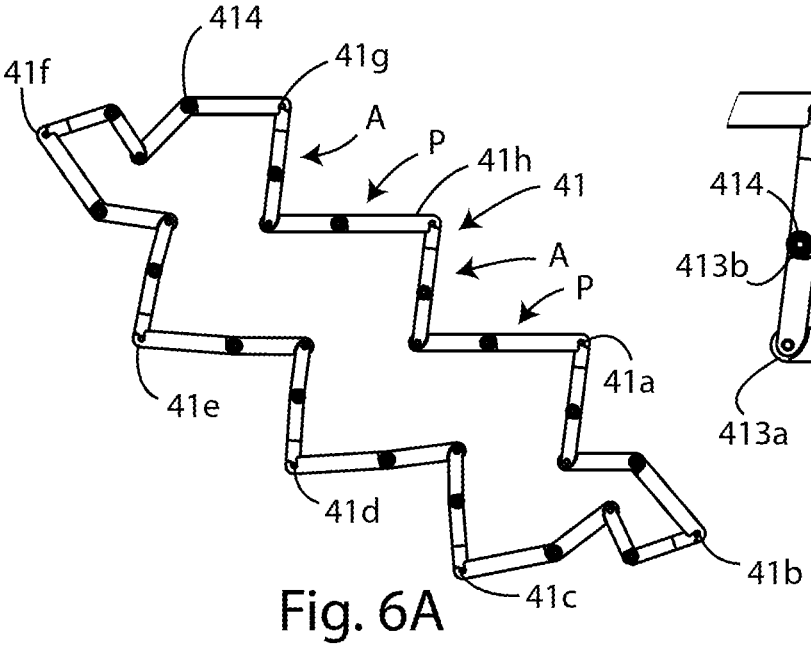
FIG. 6A shows a schematic side view of a part of the gymnastic machine of FIG. 3.
Figure 6B:
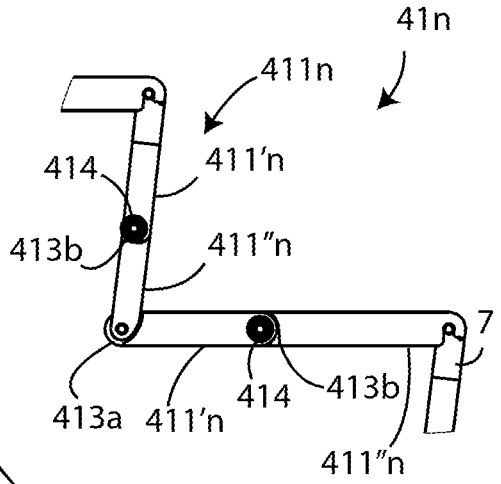
FIG. 6B shows a detail of FIG. 6A.
Figure 9A:
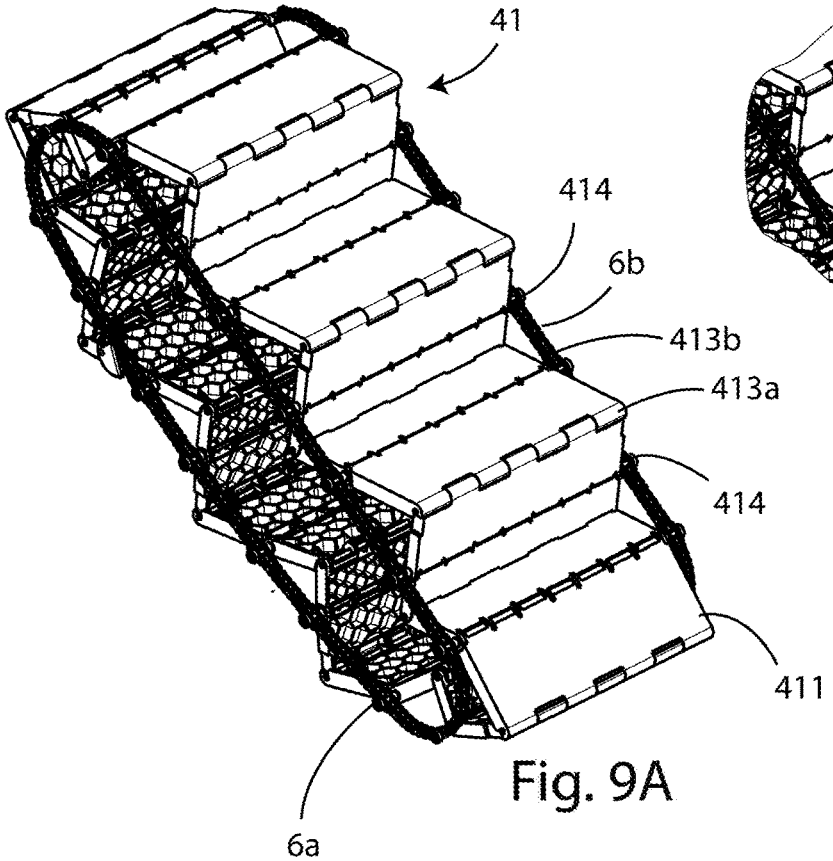
FIG. 9A shows a perspective front view of a detail of the exercise machine of FIG. 8A.
Figure 9B:
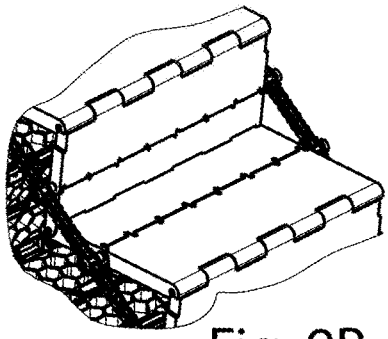
FIG. 9B shows a first detail of the exercise machine of FIG. 9A.
Figure 9C:
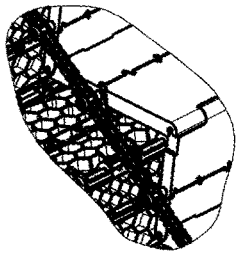
FIG. 9C shows a second detail of the exercise machine of FIG. 9A.

Referring in particular to FIG. 6B, each step $\mathbf{41}_n$ of said movable stair 41 comprises a pair of elongated elements $\mathbf{411}_n$, articulated between them by means of a main hinge 413*a*.

Each elongated element 411*n* comprises in its turn a first $\mathbf{411'}_n$ and a second $\mathbf{411''}_n$ part, which are also articulated together by means of a secondary hinge 413*b*. Said articulation secondary hinge 413*b* of said first $\mathbf{411'}_n$ and second $\mathbf{411''}_n$ part presents on its ends, two pivots 414 at the sides of each step $\mathbf{41}_n$.

Said first 411'$_n$ and second 411"$_n$ part may have the same dimension or may have different dimensions.

Said motion transmission system S comprises a main shaft 5 arranged on the top of said supporting frame 2, a first pair 6 of toothed wheels, coupled with the ends of said main shaft 5, a second pair of toothed wheels 61, mutually independent, rotatably coupled in correspondence of the lower part of said supporting frame 2, two chains 62, each left chain 62*a* and right chain 62*b* being engaged with a respective wheel of said first pair of tooted wheels 6 and a respective wheel of said second pair of toothed wheels 61.

Said two chains 62 are arranged respectively at the sides of said moving stair 41. Furthermore, each of the two chains 62 is pivoted around said pivots 414 of said articulation secondary hinge 413$_b$ of said first 411'$_n$ and second 411"$_n$ part.

Said pivots 414 slide in said pair of inclined guides 24 during the rotation of said moving stair 41.

Said motion transmission system S also comprises a braking device 7, coupled with one of the wheels of said first pair of toothed wheels 6 by means of a secondary shaft 51 and by further transmission elements, having chains and toothed wheels.

Figure 10:
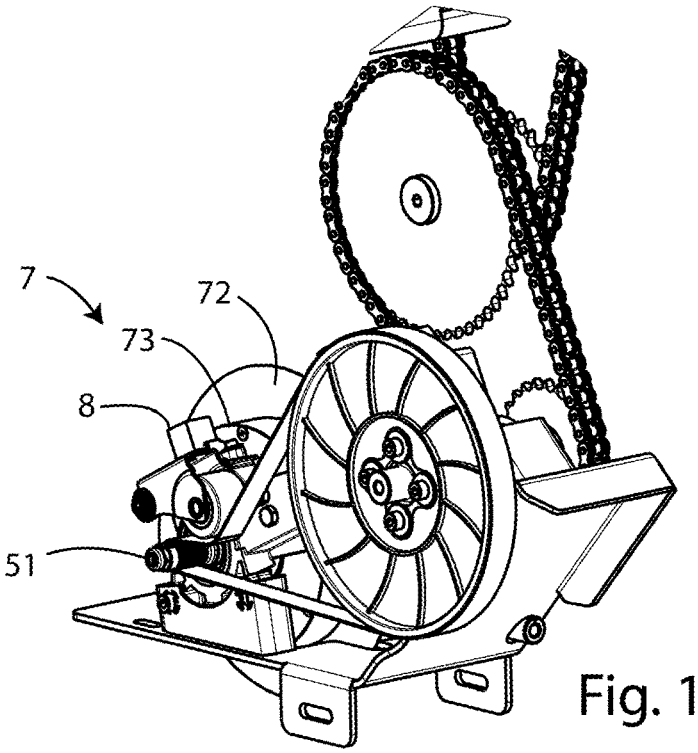
FIG. 10 shows a perspective view of a detail of FIG. 8B.
Figure 11:
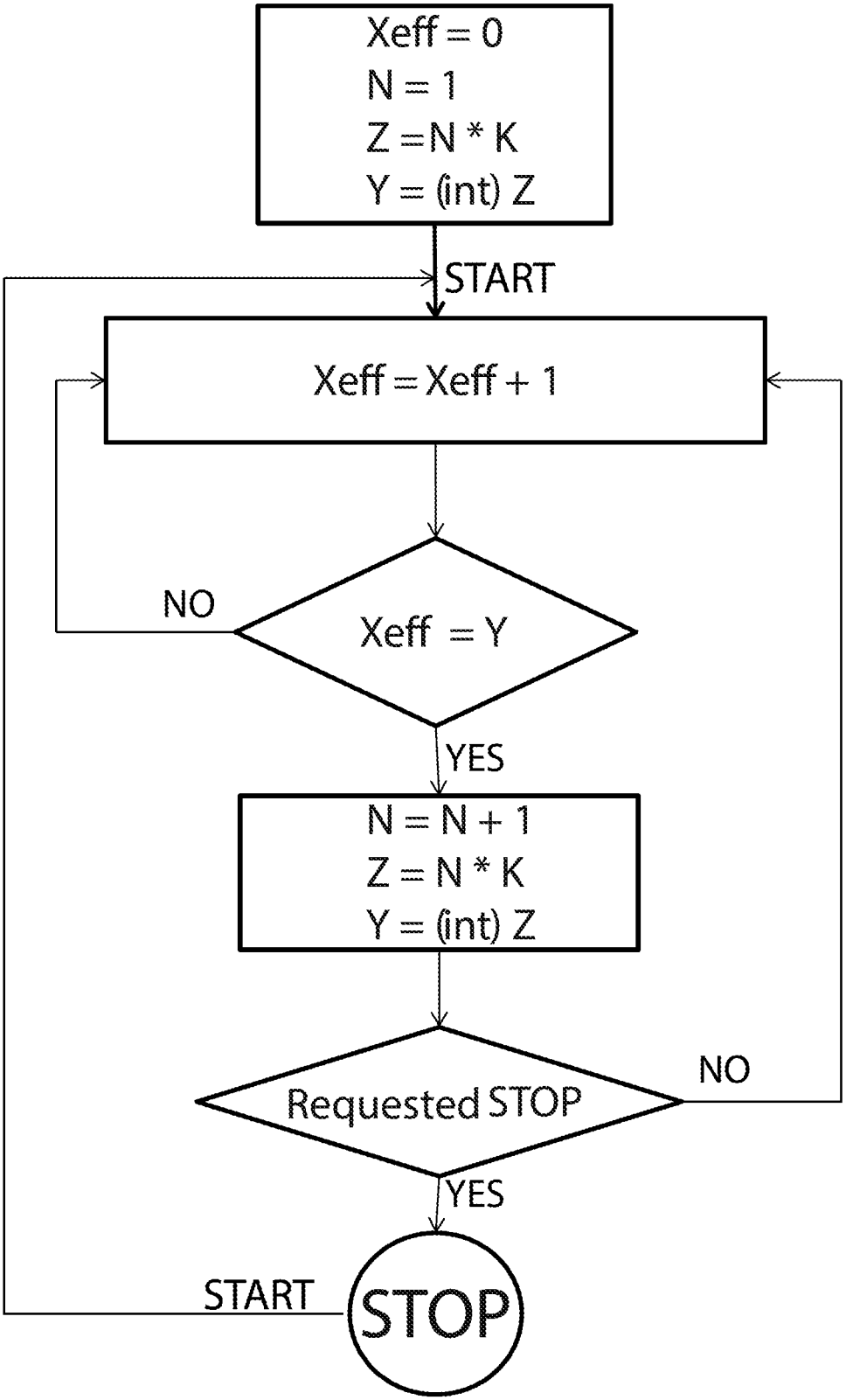
FIG. 11 shows a flow chart of the method of the present invention.

Referring in particular to FIG. 10, said braking device 7 includes an electromagnetic brake 71 coupled with a disk 72 that runs through it.

Said disk 72 is provided with a plurality of markers 73 or reading points, in particular six markers 73.

The number of markers 73 can be variable and not necessarily equal to six.

The gymnastic machine 1 is equipped with a sensor 8 arranged in correspondence of said braking device 7, so as to detect the passage of each marker 73 during the rotation of the disk 72. Upon the passage of each marker 73, said sensor 8 generates a pulse.

In a further embodiment of the present invention, as shown in the example in FIG. 8A, it is possible to fix said markers 73 on any of said toothed wheels, included in said motion transmission system S and said sensor can be placed close to any one of said toothed wheels of said motion transmission system S, to detect the passage of the markers placed on said toothed wheels (e.g., as shown by reference 8A and 8B in FIG. 8A).

In particular, in a first embodiment, said markers 73 are metal bolts and said sensor 8 is of the inductive magnetic type and detects the magnetic field change induced by the passage of said bolts during the rotation of the disk 72.

In a second embodiment, said markers 73 are made of reflective material and said sensor 8 is of the optical type. Said sensor 8 thus detects the reflection emitted by the reflective material, which said markers 73 are made of, as they pass in front of said sensor 8.

In a third embodiment, said markers 73 are holes obtained on said disk 72. In this embodiment there is a light emitter and a receiver. The emitter emits a beam of light that, when it passes through the holes 73, strikes said sensor 8, which detects the incidence of the light beam.

Said gymnastic machine 1 can also comprise a motor adapted to control the rotation of said movable stair 41, so as to control the rotation both in one direction and in a direction opposite to the ascend direction of said steps 41$_a$, 41$_b$, . . . 41$_h$.

The gymnastic machine 1 finally comprises a holding brake 9 of known type, which is used to keep blocked the gymnastic machine 1 or to stop it in the absence of current.

The operation of the gymnastic machine 1 described above is as follows.

When an user intends to execute a gymnastic exercise, rises above the movable stair 41, in particular by placing a foot on the first portion 411'$_n$ of a step 41$_n$, and presses the start button on the display unit.

Initially said movable stair 41 is in a courtesy position. Courtesy position means a position of said movable stair 41, in which the step 41$_n$ is located closer to the floor than the other steps 41$_a$, 41$_b$, . . . , 41$_h$ of the stair 41, presents the first part 411'$_n$ of an elongated element 411$_n$ in a substantially horizontal position with respect to the floor. Said elongate element 411$_n$ is in particular the tread P of said step 41$_n$.

In particular, substantially horizontal position means a position in which said first part 411'$_n$ is inclined by + or −20° with respect to the floor, preferably −10°, so that the user can comfortably place one foot for accessing the exercise machine 1 and for descending from the same.

The second part 411"$_n$ of the same elongated element 411$_n$ arranges consequently in a substantially vertical position with respect to the floor.

The user starts simulating an climb, so as to continuously rotate said movable stair 41.

The rotation of said movable stair 41 implies the rotation of the main shaft 5, which in its turn rotates said motion transmission system S and then said braking device 7, which generates a resistance to the user's motion inversely proportional to the rotation velocity of said movable stair 41, so as to make uniform the motion of said movable stair 41, accelerated or decelerated, in accordance to the requests of said user. In other words, the higher the velocity the user performs the gymnastic exercise, the greater the rotation velocity of said movable stair 41.

In particular, by rotating said main shaft 5 and said first pair of toothed wheels 6, said secondary shaft 51 rotates. Said toothed wheels 6 are rotated by said chains 62, which are guided in the motion by said pivots 414, which slide in said inclined guides 24.

Said control logic unit is provided with a program for stopping said movable stair 41 in said courtesy position, so as to ease the access of the same user for a following exercise or for the access of another user.

When the gymnastic machine 1 is started for the first time, any step 41$_n$ is positioned in courtesy position and the memory units said gymnastic machines 1 is equipped with are reset.

The following parameters are defined:

G is the number of rotations of said disk 72, between a courtesy position and the following one, and it is a fixed number by construction. For example, in one embodiment of the gymnastic machine 1, said number of rotations is equal to 54.11;

H is the number of markers 73 placed on said disk 72, which is 6 in the aforementioned embodiment;

K is the number of pulses emitted by said sensor 8 between a courtesy position and the following one, and is then calculated using the following formula:

$$K=G=H\times 6\times 54.11=324.66 \quad \text{(a)}$$

N is a number, which is stored in said memory of said exercise machine 1 and is the ordinal number of the following useful courtesy position. Its value starts from 1, when the exercise machine 1 is operating and when the initial reset operation is performed, and is periodically incremented by one unit, as it will be described in detail hereinafter;

Z is a number that is stored in said memory of said gymnastic machine 1, for calculating the total number of pulses associated with the following useful courtesy position, which follows during the execution of a gymnastic exercise and it is calculated by the following formula:

$$Z=N\times K \quad (b)$$

Y is the integer part of Z and represents the number of pulses corresponding to the following useful courtesy position N;

$X_{eff}$ is an instantaneous counter that instead takes into account of the actual number of pulses detected by said sensor 8.

Said numbers N and Z and said counter $X_{eff}$ are never reset to zero at the end of a gymnastic exercise, but can be reset during periodic maintenance of said gymnastic machine 1.

The values of Y and $X_{eff}$ are compared whenever said sensor 8 detects a pulse, if the condition $X_{eff}>Y$ occurs, then the value of N is increased by one unit, during the whole gymnastic exercise.

At the end of the gymnastic exercise, the user presses a stop button on said display unit and said movable stair 41 is slowed so as to stop, to allow the descent of said user from said exercise machine 1.

However, said movable stair 41 would not stop in a courtesy position, therefore, to ease the access to the exercise machine 1 by another user or the descent of the same user, said control logic unit has to control the stop of said movable stair 41 in a courtesy position.

Therefore, said control logic unit reads said values Y and $X_{eff}$ and a carries out a following comparison between them.

For example, it is assumed that, when the user has requested the exercise machine 1 to stop, counter N is equal to 49, i.e. equal to the next useful courtesy position with respect to the one just passed, i.e. N=48.

According to the formula (b), $Z_{49}=49\times324.66=15{,}908.34$.

The final stop position, the movable stair 41 will take is obtained by calculating the integer part of $Z_{49}$, i.e. $Y=|Z_{49}|=15{,}908$ pulses.

Therefore, when the $X_{eff}$ value reaches a number of 15,908 pulses, said control logic stops said main shaft 5.

After this operation, said gymnastic machine 1 is ready to carry out a new exercise, during which all of the counters will again be modified in accordance with this operating logic.

As it is obvious from the above description, said gymnastic machine 1 has several advantages compared to prior art machines.

The structure of said steps $\mathbf{41}_a$, $\mathbf{41}_b$, . . . , $\mathbf{41}_h$ is made of a plurality of parts movable each other around hinges allows a more convenient access for a user, because the height from the floor of the tread of the first step is lower than known machines.

Furthermore, since the control logic is equipped with a suitable calculation program, it is always possible bringing the movable stair in a comfortable courtesy position for ascending and descending the gymnastic machine by a user, without the introduction a sensor in addition to the one needed for controlling the execution velocity of the gymnastic exercise.

The present invention has been described for illustrative but not limitative purposes, according to its preferred embodiments, but it is to be understood that modifications and/or changes can be introduced by those skilled in the art without departing from the relevant scope as defined in the enclosed claims.

The invention claimed is:

1. A gymnastic machine having movable steps, comprising:

a supporting frame configured for resting said gymnastic machine on a floor; and a movable stair comprising a plurality of elongated elements, each elongated element being directly hinged by main hinges in series to a preceding elongated element and to a following elongated element so as to form a closed series, two consecutive elongated elements forming a step of said movable stair acting respectively as tread and riser, wherein each elongated element comprises at least one first and one second part directly articulated to each other by a secondary hinge to form a single tread or riser.

2. The gymnastic machine according to claim 1, further comprising a motion transmission system, installed on said supporting frame, to transmit motion to said movable stair.

3. The gymnastic machine according to claim 2, wherein said motion transmission system comprises two transmission members comprising a chain or belt arranged respectively at each side of said movable stair, and said transmission members are hinged on said secondary hinges.

4. The gymnastic machine according to claim 3, wherein said motion transmission system comprises:

a main shaft arranged on an upper part of said supporting frame, a first pair of toothed wheels coupled to ends of said main shaft, a second pair of toothed wheels rotatably coupled in correspondence of a lower part of said supporting frame, and each of said two transmission members are engaged with a respective toothed wheel of said first pair of toothed wheels and a respective toothed wheel of said second pair of toothed wheels.

5. The gymnastic machine according to claim 4, wherein said motion transmission system further comprises a braking device, coupled with one of the toothed wheel of said first pair of toothed wheels by further transmission members of said motion transmission system.

6. The gymnastic machine according to claim 5, wherein said braking device comprises an electromagnetic braking member coupled with a disk.

7. The gymnastic machine according to claim 6, wherein said disk is provided with a plurality of markers on its surface, and said gymnastic machine comprises a sensor, arranged in correspondence of said braking device, so as to detect a passage of each marker during a rotation of said disk, so as to emit a pulse.

8. The gymnastic machine according to claim 4, wherein any one of said first pair or second pair of toothed wheels or further toothed wheels of said motion transmission system is provided with a plurality of markers, and said gymnastic machine comprises a sensor, arranged in correspondence of said first pair or second pair of toothed wheels or said further toothed wheels of said motion transmission system, so as to detect a passage of each marker during a rotation of said first pair or second pair of toothed wheels or said further toothed wheels of said motion transmission system, so as to emit a pulse.

9. The gymnastic machine according to claim 2, wherein said movable stair and said motion transmission system are configured so that, during a rotation of said movable stair, said first part of each elongated element, when it is in close proximity to the floor, articulates itself with respect to said second part of the same elongated element, and arranges substantially horizontal to said floor.

10. The gymnastic machine according to claim 1, wherein each first part of each elongated element is directly articulated to the second part of the preceding elongated element and each second part of each elongated element is directly articulated to the first part of the following elongated element.

11. The gymnastic machine according to claim 1, wherein each first and second part of each elongated element have the same dimensions.

12. The gymnastic machine according to claim 1, wherein each articulation secondary hinge of said first and second part of each elongated element has two pivots at its ends.

13. The gymnastic machine according to claim 1, further comprising a control logic unit, provided with a program to calculate a stop position of said movable stair at the end of a gymnastic exercise, so that said first part of each elongated element, when in close proximity of the floor, arranges substantially horizontal with respect to said floor.

14. An operating method of the gymnastic machine of to claim 1, comprising:

a. reducing a rotation speed of said movable stair of said gymnastic machine;

b. stopping said movable stair in a final stop position so that the first part of the elongated element, which is in close proximity of the floor, is substantially horizontal to said floor.

15. The operating method of claim 14, wherein the transition from said step a. to said step b. takes place by rotating said movable stair in a first direction or in a second opposite direction.

16. The operating method of claim 15, wherein a control logic unit of said gymnastic machine stores a plurality of values, which measure a number of pulses emitted by a sensor of said gymnastic machine and a number of rounds of a disk of a braking device of said gymnastic machine during an operation of said gymnastic machine, and by running said step b., carrying out a reading, a comparison and an update of said values according to a predetermined procedure.

* * * * *